US011587424B1

(12) United States Patent
Hupps et al.

(10) Patent No.: US 11,587,424 B1
(45) Date of Patent: Feb. 21, 2023

(54) LASER MONITORING SYSTEM

(71) Applicants: Brian Hupps, Port St. Lucie, FL (US); Jason A. Eulette, Doral, FL (US)

(72) Inventors: Brian Hupps, Port St. Lucie, FL (US); Jason A. Eulette, Doral, FL (US)

( * ) Notice: Subject to any disclaimer, the term of this patent is extended or adjusted under 35 U.S.C. 154(b) by 243 days.

(21) Appl. No.: 17/120,189

(22) Filed: Dec. 13, 2020

Related U.S. Application Data

(63) Continuation-in-part of application No. 16/430,557, filed on Jun. 4, 2019, now Pat. No. 10,867,503.

(60) Provisional application No. 62/680,741, filed on Jun. 5, 2018.

(51) Int. Cl.
*G08B 21/04* (2006.01)
*G08B 3/10* (2006.01)

(52) U.S. Cl.
CPC ..... *G08B 21/0461* (2013.01); *G08B 3/10* (2013.01)

(58) Field of Classification Search
CPC ..... G08B 21/0461; G08B 3/10
USPC ..... 340/501
See application file for complete search history.

(56) References Cited

U.S. PATENT DOCUMENTS

| | | | | |
|---|---|---|---|---|
| 10,205,913 | B2 * | 2/2019 | Smith | G08B 29/185 |
| 10,586,442 | B1 * | 3/2020 | Jensen | G08B 13/19691 |
| 2008/0169931 | A1 * | 7/2008 | Gentry | G08B 21/22 600/300 |
| 2017/0221340 | A1 * | 8/2017 | Rhoads, Jr. | G04G 13/021 |
| 2020/0077925 | A1 * | 3/2020 | Ovalle | A61B 5/6891 |

* cited by examiner

*Primary Examiner* — Hirdepal Singh
(74) *Attorney, Agent, or Firm* — David Colls

(57) ABSTRACT

A laser monitoring system designed to prevent accidental falls of people who are at high risk of falling when they try to get up from a chair, commode, or bed. The system includes a first unit providing a circuit board, a laser emitting device, an alignment indicator, a control button, a communicator, an alarm speaker, an electrical port, and an electrical housing that retains all of the above. The system also includes a second unit providing a circuit board, a laser receiving device, an alignment indicator, and receiver which are all retained inside of an electrical housing. The first unit and second unit form a laser net alarm system that when interrupted provides an audible alarm requesting that the patient wait for medical attention, while at the same time may notify the care giver that their patient is trying to get up unassisted by sending an electronic message to the care giver's electronic device.

20 Claims, 15 Drawing Sheets

LASER MONITORING SYSTEM

CROSS-REFERENCE TO RELATED APPLICATIONS

This U.S. Nonprovisional patent application claims the benefit of U.S. Nonprovisional patent application Ser. No. 16/430,557, having a filing date of Jun. 4, 2019, which in turn claims the benefit of Provisional patent application Ser. No. 62/680,741, having a filing date of Jun. 5, 2018, both of which are incorporated herein in its entirety.

FIELD OF THE INVENTION

The present invention relates generally to monitoring systems, and more particularly, to a laser monitoring system that can be used to prevent accidental falls of patients that are left unattended. The laser monitoring system is designed to alert a care giver that a patient is trying to get up unattended, and may include an electronic messaging alert feature that sends an electronic message to the care giver via a wireless network notifying them that the patient is getting up unattended.

BACKGROUND OF THE INVENTION

For the first time in history, people of all classes around the world are likely to live to 60 years of age or beyond. Longevity is one of the greatest achievements of our modern era, and called by the United Nations as one of the most significant social transformations of the 21$^{st}$ century. Our success in achieving longevity, however, is ironically short lived by the compromised quality of life many people live plagued with poor health and the loss of autonomy. For instance, there are an increased number of people who develop degenerative brain diseases, such as, dementia, Alzheimer, and Parkinson because they are outliving their mind's functional ability.

This translates to a large number of people being hospitalized each year, which creates an entire new set of problems and a major concern for health care organizations as they try and focus on patient care. A particular focus by health organizations is on preventing falls. Unfortunately, patients who suffer from a brain degenerative disease have a high propensity of falling because they try and get up while they are confused or disoriented. According to the Center for Disease Control (CDC), falls are the leading cause of hospital acquired injuries and are estimated to directly cost hospitals approximately $31 billion annually.

Although a hospital's nursing staff, homes care givers, and other health care organizations staff continuously strive to provide the best care for their patients, they are unable to remain at the beside of every patient who is at a high risk of falling. Accordingly, facilities have turn to alert mechanisms that alert them if a patient is about to have a fall. Some of these alert mechanisms include a pressure pad system. This type of system, however, is heavily flawed. In order for the system to alert the nurse or care giver that the patient is getting up, the patient must completely come off the pad. By the time the patient is completely off of the pad, the patient is already at serious risk of falling, or worse, already fallen.

Another type of monitoring system includes a device that has a string attached to a clip that is attached to the patients clothing or gown. When the patient moves and the string tenses the system alerts a health care professional that the patient is trying to get up. However, a mayor disadvantage is that the patient can easily remove the clip attached to their clothing before getting up.

Alternative preventative fall apparatuses include physical restraints that confine a patient to a bed or chair. This approach, however, puts the patient at risk of other types of injuries that may include psychological harm. Pharmaceutical restraints put the patient in a drowsy state that prevents them from moving. Although this approach is somewhat effective, once the effects of the medication ware off the patient is once again at risk of falling. Not to mention the adverse effects of being medicated for long periods of time.

Accordingly, there is an established need for a monitoring system that uses a laser system that triggers an audible and electronic messaging alarm to alert a care giver that a patient is getting up unattended.

SUMMARY OF THE INVENTION

The present invention is directed to a laser monitoring system that can be used in hospitals, nursing homes, personal homes, or the like, to help prevent accidental falls. The system is designed to trigger audible alarms to alert a care giver that a patient is about to get up unattended.

Introducing a first embodiment of the invention, a laser monitoring system, comprising: a first unit, a second unit, and a universal mount affixed to the first unit and the second unit. The universal mount attachable to a mounting arm, wherein the first unit and the second unit are selectively linked to one another to provide a penetrable laser net alarm.

In another aspect, the first unit comprises, a circuit board, a laser emitting device, a first alignment indicator, at least two control buttons, an alarm speaker, at least one communication port. The communication port may be connected to a connection line to selectively link the first unit to the second unit. An electrical port for receiving an electrical connector to energize the first unit may be provided. And, an electrical housing having an internal space for retaining the circuit board, the laser emitting device, the first alignment indicator, the at least one control button, the at least one communication port, the electrical port, and the alarm speaker is provided.

In yet another aspect, the second unit comprises, a circuit board, a laser receiving device, a second alignment indicator, at least one receiving port, and an electrical housing to retain the circuit board, laser receiving device, indicator, and port.

In another aspect, the laser emitting device may comprise of, at least one alignment laser, at least one activation laser, and at least one alarm laser.

In a another aspect, the laser receiving device may comprise of, at least one laser alignment sensor, at least one laser activation sensor, and at least one laser alarm sensor.

In yet another aspect, the second alignment indicator of the second unit may include at least one LED light that indicates proper alignment and improper alignment of the second unit with the first unit.

In yet another aspect, the first alignment indicator of the first unit includes at least one LED light that indicates proper alignment and improper alignment of the first unit with the second unit.

In another aspect, an audible alarm may be played from the alarm speaker when the penetrable laser net alarm is interrupted and subsequently uninterrupted by a person.

In still another aspect, the audible alarm may be a pre-recorded message of someone known requesting a patient to remain seated until help arrives.

In still another aspect, the first unit and second unit may be attached to a commode, chair, bed, or the like.

In yet another aspect, the second unit further comprises an internal timer to prevent false alarms the penetrable laser emitted from the system is interrupted accidently.

In yet another aspect, the first unit and second unit are communicable with a wireless device via a wireless network.

In yet another aspect, the alarm provided by the system may be triggered when the laser provided by the system is interrupted and subsequently uninterrupted by a person for a pre-set duration of time.

In yet another aspect, the set duration of time may be a time range of approximately 2-7 seconds.

In another aspect, the alarm may include a generic audible alarm message requesting that the patient remain seated until help arrives.

In another aspect, the alarm may include and an electronic message that is sent wirelessly via a wireless network to an electronic device carried by the care giver notifying them that their patient is about to get up unattended.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
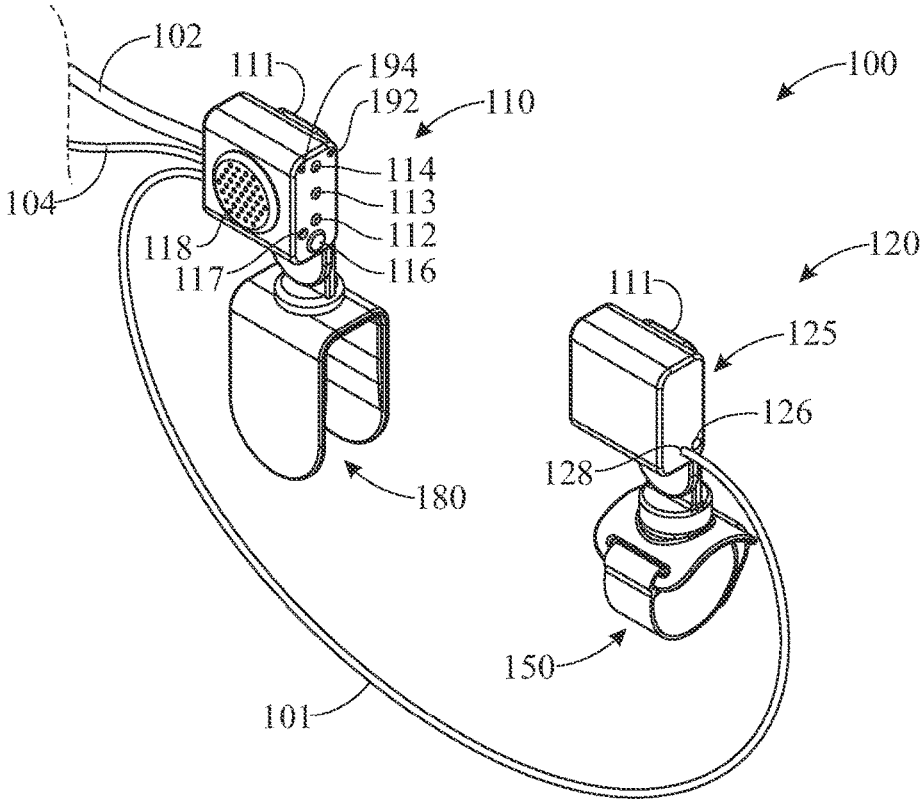
FIG. 1 presents a front isometric view of a first embodiment of a laser alert system.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-15, and initially to FIGS. 1-4, a laser monitoring system 100 is illustrated in accordance with an exemplary embodiment of the present invention. The laser monitoring system 100 generally includes a first unit 110 (hereinafter referred to as an emitting unit) and a second unit 120 (hereinafter referred to as a receiving unit). The emitting unit 110 and receiving unit 120 are connected by a cable 101, allowing each unit to communicate with each other. Cable 101 connects to port 103 on the emitting unit 110 and to port 128 on the receiving unit 120. It is contemplated that unit 120 include and be equipped with an additional connecting port 126 in the event an additional unit is needed. Unit 120 may also include an electrical housing 108 that provides the unit's circuit board, laser emitters, led lights, ports, control buttons, and alarm speaker.

Figure 15:
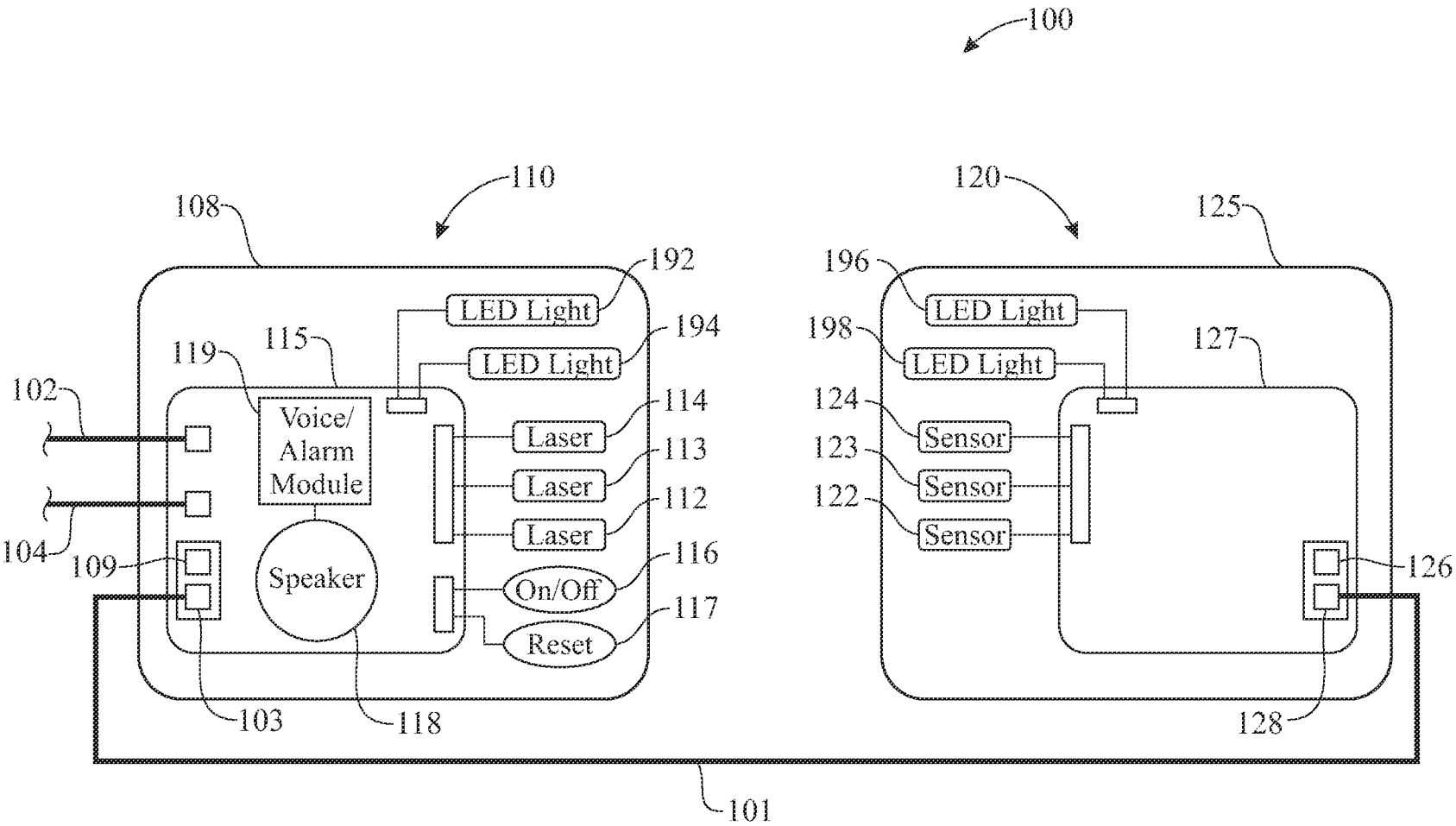
FIG. 15 presents a logic schematic.

Moving specifically to FIGS. 1 and 15, unit 110 may include at least 3 emitting lasers; one laser 112 may be provided for the purpose of alignment, a second laser 113 may be utilized for the activation of the unit, and the third laser 114 may be used to trigger an alarm. The unit 110 may also include LED lights 192, 194 that function as alignment indicators, where LED light 192 indicates an error (e.g., if the units are unaligned), and LED light 194 indicates no error (e.g., that the units are properly aligned). Unit 110 may also include a speaker 118 that can be used to broadcast a voice or sound alarm when the alarm is triggered.

Figure 2:
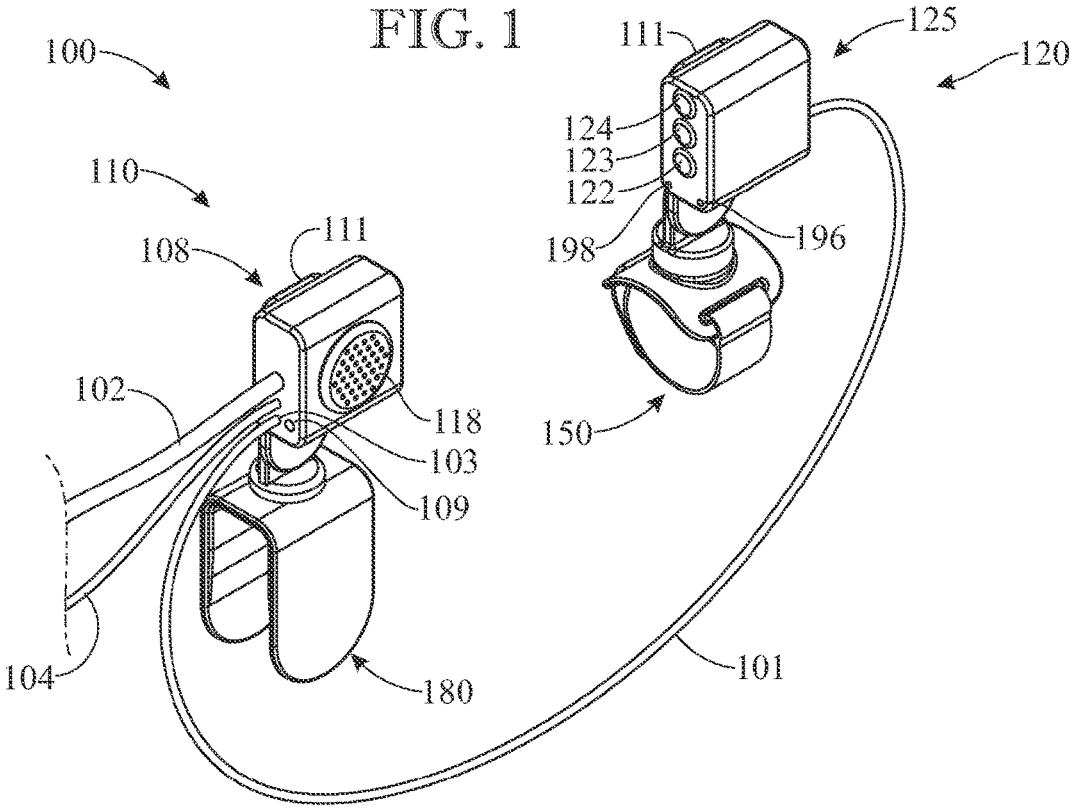
FIG. 2 presents a rear isometric view of the laser alert system originally shown in FIG. 1.

As is best illustrated in FIGS. 2 and 15, the receiving unit 120 may include a circuit board 127, laser sensors, LED lights, and ports all stored within housing 125. Unit 120 may further include at least 3 laser sensors; one laser sensor 122 may be utilized for alignment, a second laser sensor 123 may be used for activation purposes, and a third laser sensor 124 may be used to trigger an alarm. The voice alarm broadcasted by the speaker 118 may include a voice recorded message that has been pre-recorded by one of the patient's family member requesting the patient stay in bed, and wait for a healthcare professional to help them. Alternatively, the alarm may include a generic voice recording that requests the patient to wait for a healthcare professional to help them. As seen in the accompanying drawings, the unit 120 may also include LED lights that may be used as alignment indicators. For example, LED light 198 may be used to indicate an error (or improper alignment), and light 196 may be used to indicate proper alignment. Similar to unit 110, unit 120 may also include an additional port 109 to selectively add an additional sensor. The system 100 may also include a timer that is incorporated into the coding of the system's circuit board, and may be utilized to prevent the triggering of a false alarm by someone waving a foreign object in front of the alarm laser 107, for example, a hand, or moving a toilet seat up and down, etc. It should also be readily understood by one of ordinary skill in the art that additional emitting lasers and sensors may be added to units 110 and 120.

Figure 4:
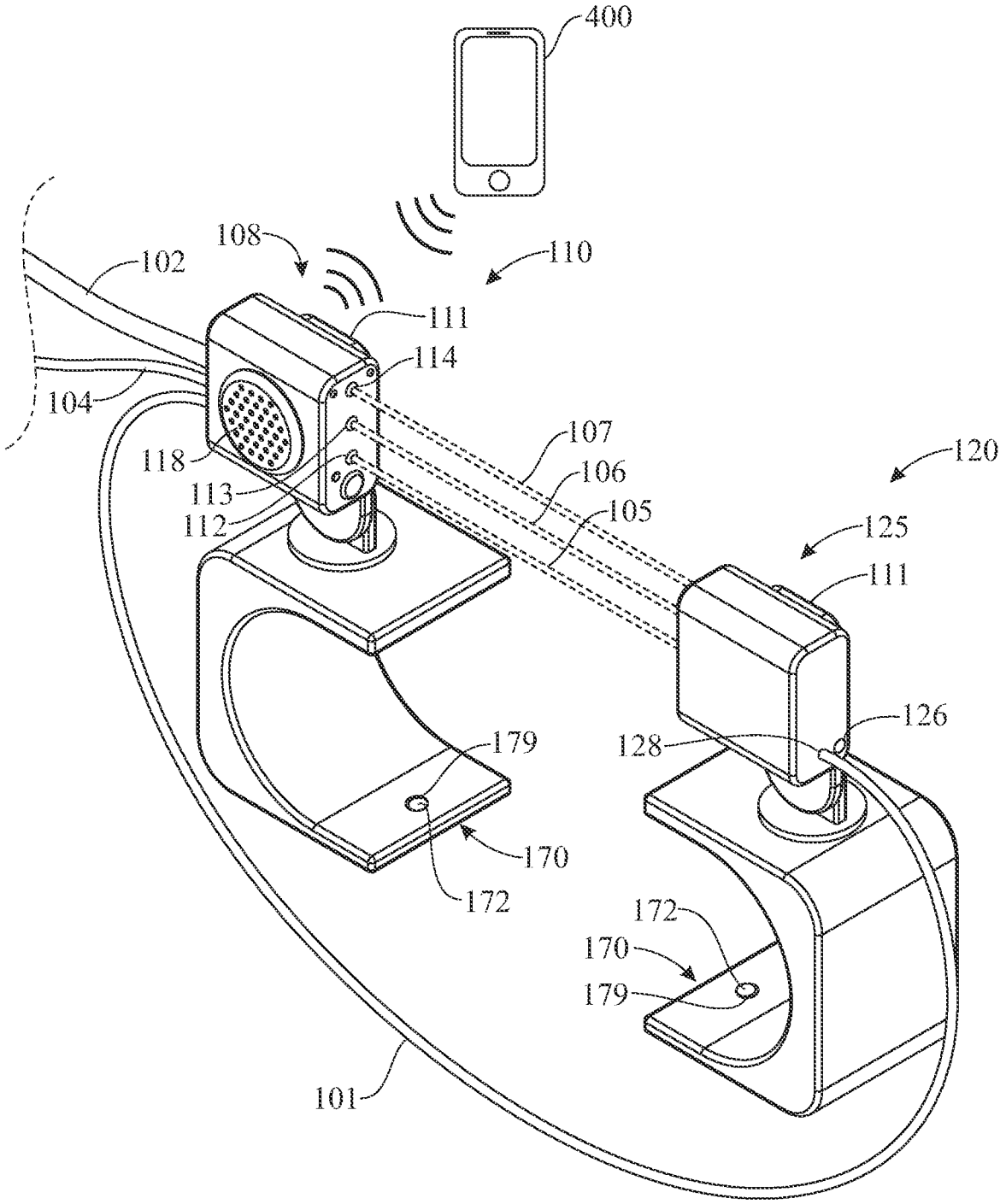
FIG. 4 presents an isometric view of the laser alert system shown in FIG. 1, being selectively attached to a C-mount bracket.
Figure 12:
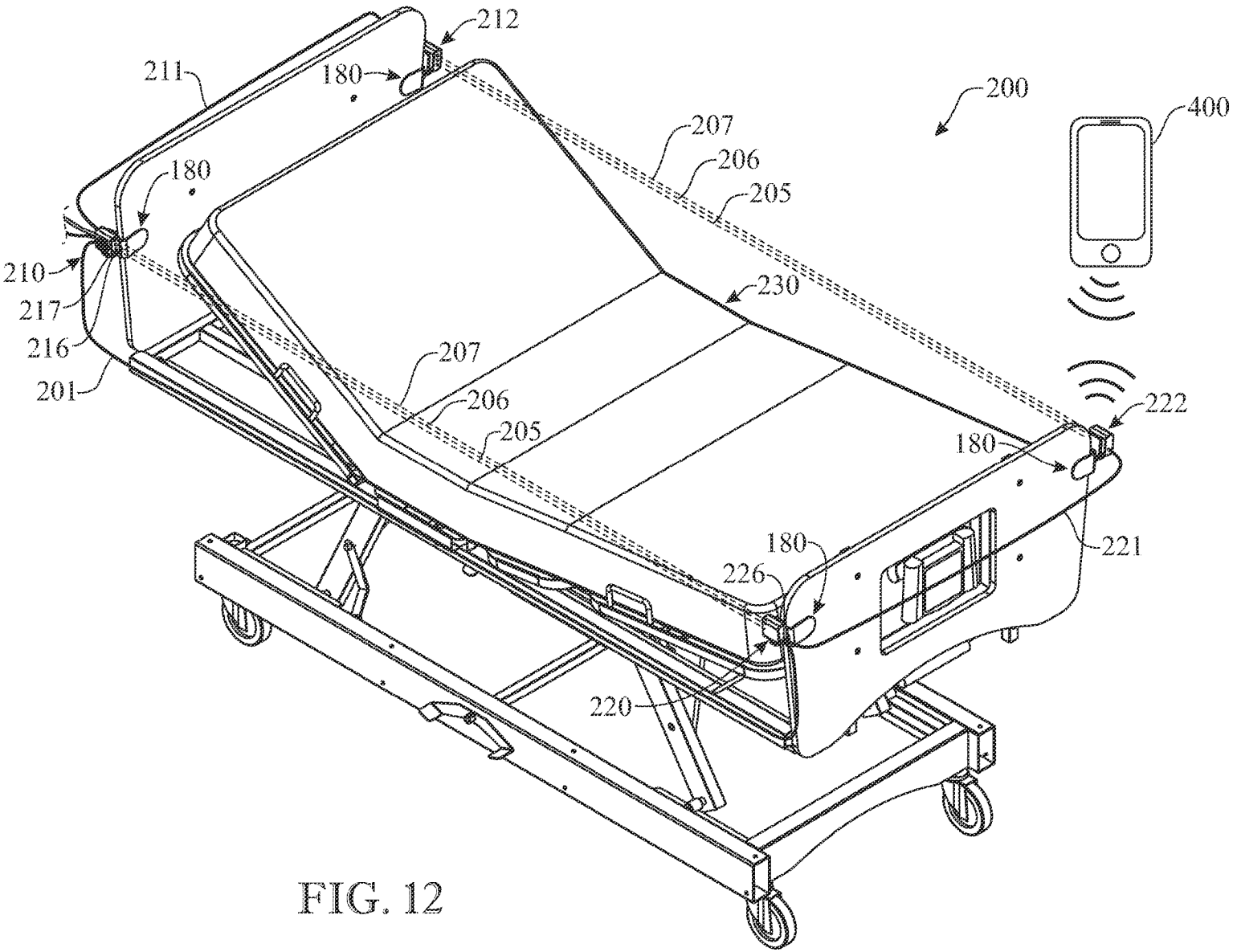
FIG. 12 presents a front isometric view of the laser alert system originally shown in FIG. 1, being selectively mounted to a hospital bed at the foot and head of the bed.

Turning now to FIGS. 1, 4 and 15, the system 100 may include at least two control buttons on unit 110. One button being an On/Off switch 116, which controls the power to the unit, and a second button that may function as a reset button 117, which delays and/or resets the laser emitters and alarm. The On/Off switch 116 provided on the unit 110 may include a safety feature that prevents accidental, or in some instances, an intentional act, to turn off the system 100. For example, the unit 100 may require a combination of buttons be pressed simultaneously as the On/Off switch in order shut off. Of course, it should be readily understood by those skilled in the art that additional controlled features may be added to the unit. For instance, the unit may include a Bluetooth link button that allows the unit to sync to a mobile device or the like. Or, the system 100 may have the capacity to connect to a wifi network 402 that permits connection to the care givers a mobile device 400 (as illustrated in FIG. 12). Once the system and electronic device 400 are in sync, a message may be sent from the unit to the mobile device 400, tablet, pager, or smart watch, notifying the care giver that the patient is trying to get up. For example, the message sent could be in the form of a text message or automated call. Unit 110 may also include a power supply cord 104 that connects and energizes the electrical contents inside of housing 108. Although it is not shown in the accompanying figures, it is contemplated that system 100 include wireless means or a communication cable 102 that feeds from housing 108 and connects to an existing communication system provided by the health care provided, thereby syncing both systems to work in tandem. It also contemplated that the unit be able to run on reserve power should it be accidentally disconnected and produce a loud audible sound notifying the care giver that the unit is disconnected and running low on power.

Figure 3:
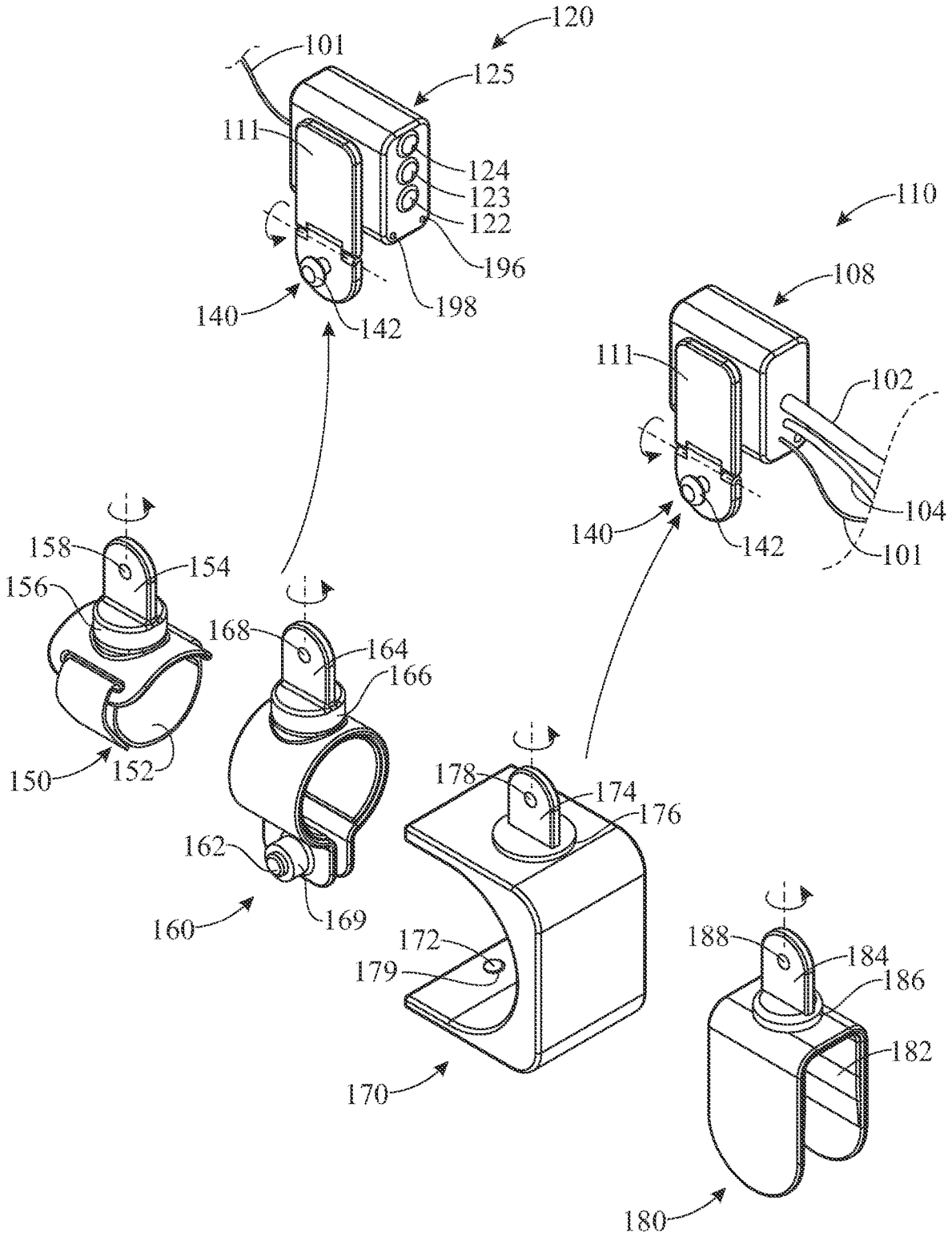
FIG. 3 presents an isometric view of the laser alert system shown in FIG. 1, being selectively attachable to a plurality of mounting attachments.

Referring now to FIG. 3, the emitting unit 110 and the receiving unit 120 can both be selectively attached to a universal mount 140. The mount 140 includes a support member 111 that may be selectively attached to a swivel arm 140 that includes a notch 142. The universal mount 140 can subsequently be selectively attached to a plurality of additional mounts. For example, as shown in FIG. 3, universal mount 140 can be attached to a swivel strap attachment 150. The swivel strap attachment may include a mounting tab 154, a mounting hole 158 that engages notch 142, a swivel cap 156, and a hook and loop strap 152. In another example, the universal mount 140 may be mounted to a different type of mount, such as, a swivel clamp 160. The swivel clamp 160 may include a mounting tab 164, a mounting hole 168 that engages notch 142, a swivel cap 166, and a nut 169 and clamp screw 162. In yet another example, universal mount 140 may be selectively coupled to a swivel C-mount 170. The C-mount, which is also shown in FIG. 3, may include a mounting tab 174, a mounting hole that engages notch 142, a swivel cap 176, a clamp screw 172, and a threaded hole 179. And, finally, in still another example, universal mount 140 may be selectively coupled to a swivel U-mount attachment 180. The U-mount attachment 180 may include a mounting tab 184, a mounting hole 188, a swivel cap 186, and a compressible material lining 182 on the inner surface of the u-shaped channel on the U-mount 180. Of course, it should be readily understood that universal mount 140 may be selectively attached to additional mounts that are not provided in the accompanying figures, and, as such, said mounts described heretofore should not be considered limiting.

The mounting of units 110 and 120 to an object (e.g., commode, toilet, chair or bed), and the alignment of said units is now discussed with reference to FIGS. 4-14.

Turning specifically to FIGS. 4-9, in accordance with one exemplary embodiment of the present invention, unit 110 and unit 120 is shown coupled to a swivel C-mount 170 via universal mount 140. This particular mount (i.e., swivel C-mount 170), may be utilized with objects that are difficult to attach to, and do not include features that the other type of mounts as have been described herein above may be coupled to. However, alternative mounts and combination of mounts may be utilized in instances where a more desirable mount is needed. For instance, the combination of a C-mount and a clamp mount may be utilized to achieve the present invention's objective. Therefore, the following description of the present invention being mounted to an object, toilet, commode, recliner, chair, bed, or the like, should not be construed as limiting, but exemplary.

Figure 5:
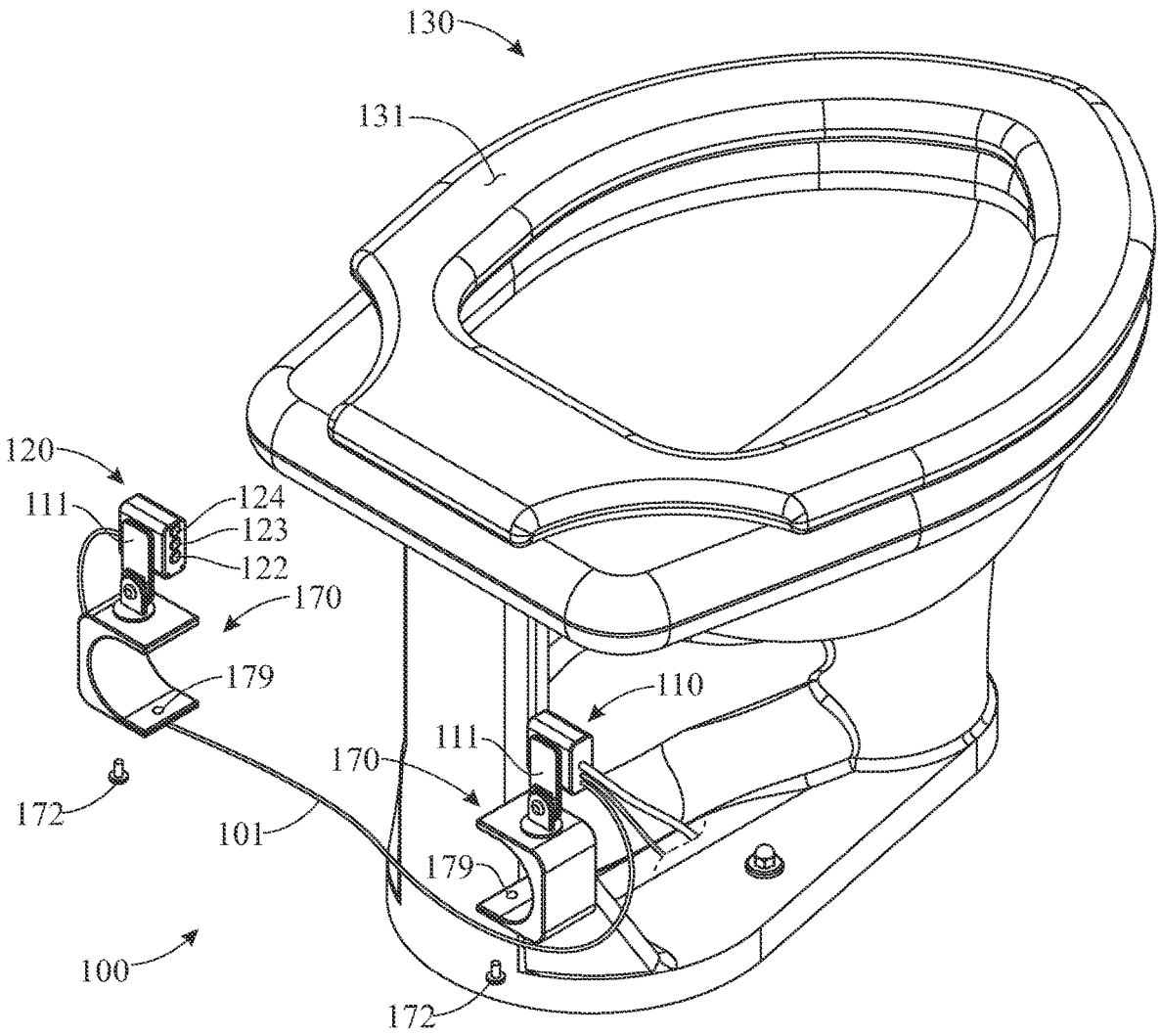
FIG. 5 presents a rear isometric view of the laser alert system shown in FIG. 4, just before it is selectively mounted to a toilet.
Figure 6:
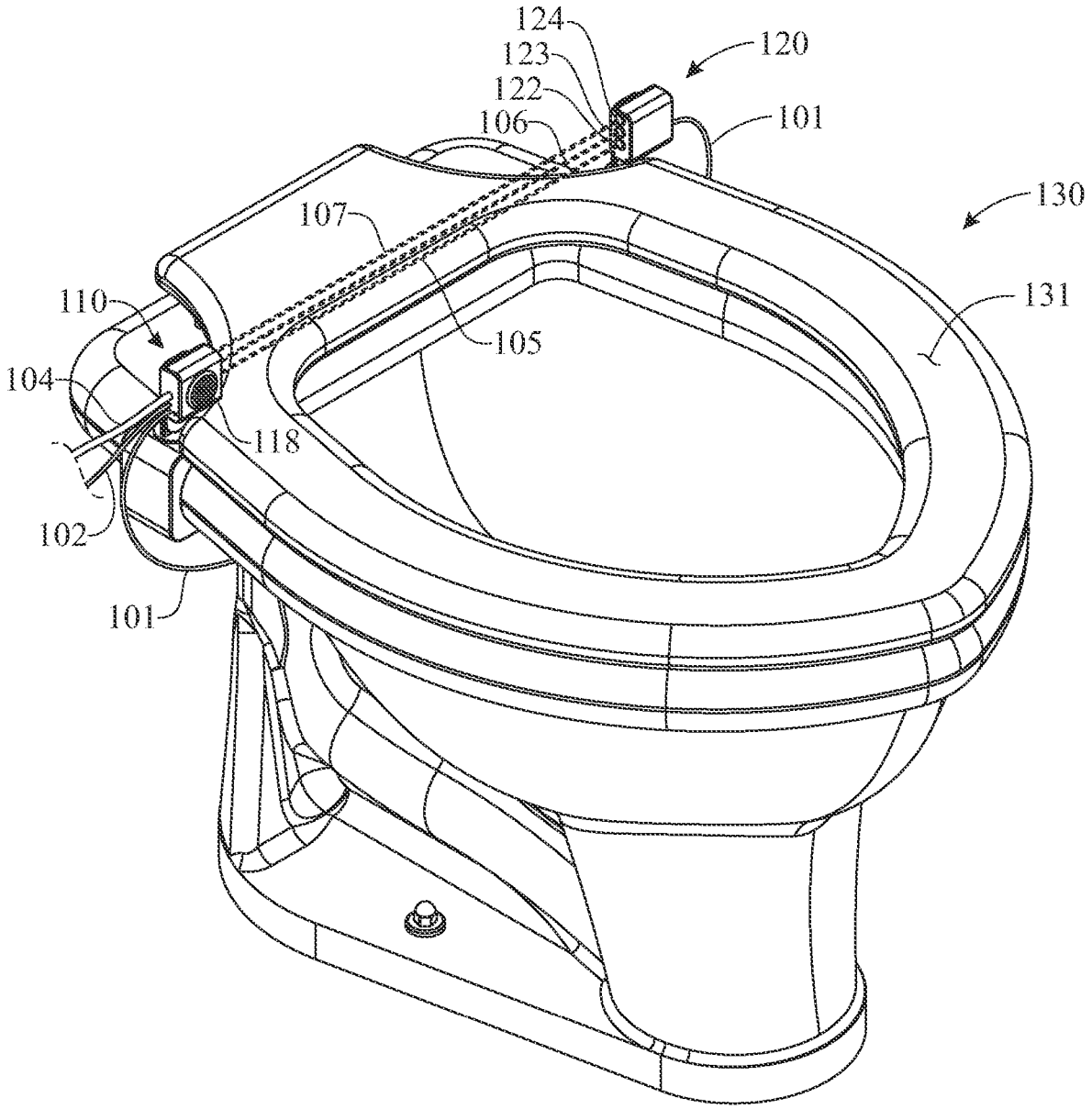
FIG. 6 presents a front isometric view of the laser alert system shown in FIG. 4, selectively mounted to a toilet.
Figure 7:
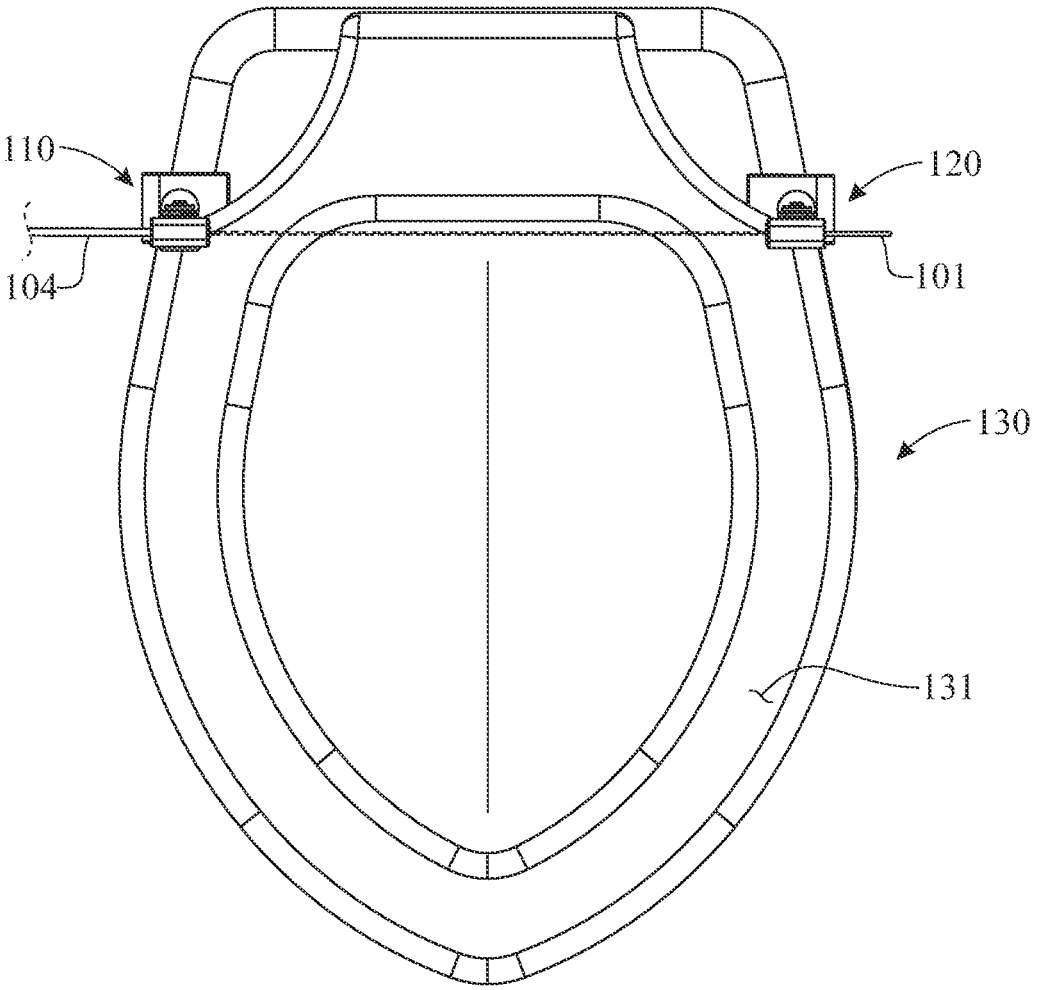
FIG. 7 presents a top view of the laser alert system mounted to the toilet.
Figure 8:
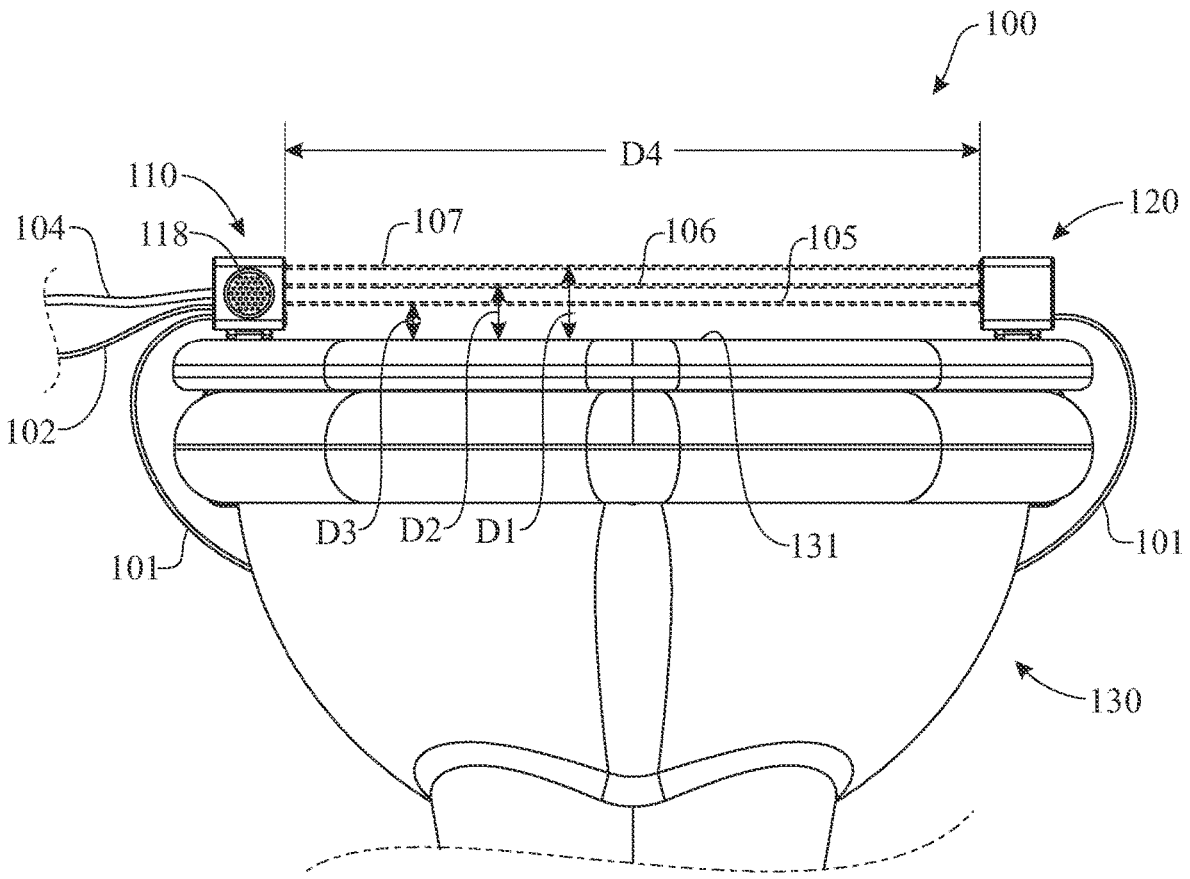
FIG. 8 presents a front view of the laser alert system mounted to the toilet with the C-mounting bracket originally shown in FIG. 4.
Figure 9:
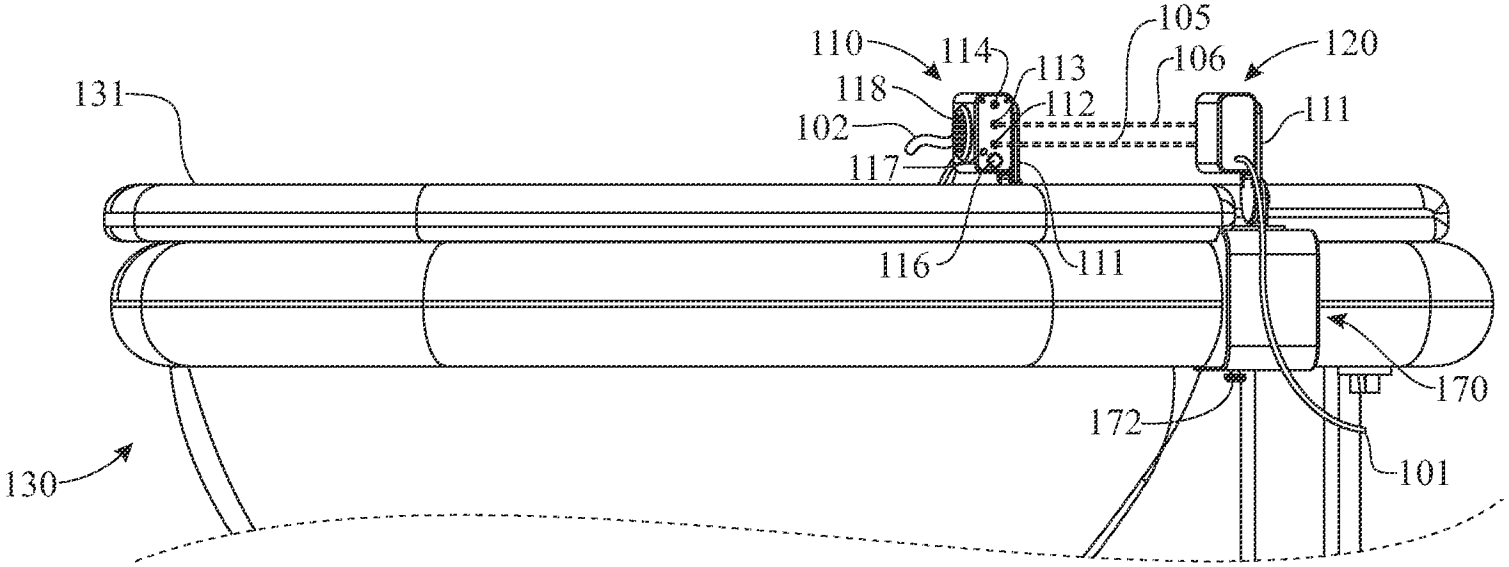
FIG. 9 presents a right side skewed view of the laser alert system.

As shown in FIG. 5, unit 110 and unit 120 may be selectively attached to the upper area of an object 130, which in this case is shown as a toilet with toilet seat 131 where a person would sit. After coupling unit 110 and unit 120 to object 130 with an appropriate mount (in this example being a C-mount), both faces of each unit are lined up in front of each other (i.e., with each side panel being parallel to one another, as clearly depicted in FIG. 8) a distance D4. The distance each unit is set up with respect to the other is adjustable, and may vary depending on the object the system is being coupled to. Once the units are aligned, the lasers being emitted from the emitting unit 110, such as, the alignment laser 105, the activation laser 106, and the alarm laser 107 make contact with each respective sensor. In other words, alignment laser 107 is received by alignment sensor 122, activation laser 106 is received by activation 123, and alarm laser 107 is received by alarm sensor 124. The alignment of the lasers can be best seen in FIG. 7. Once the lasers are aligned, and as illustrated in one exemplary embodiment of the present invention in FIG. 8, the lasers being emitted by the system 100 are projecting at different distances above the surface 131 of object 130. For example, D1 is measuring the vertical distance from surface 131 to the horizontal projection of alarm laser 107. D2 is measuring the vertical distance from the surface 131 to the horizontal projection of activation laser 106, and D3 is measuring the vertical distance from the surface 131 to the horizontal projection of alignment laser 105.

In the event the units are not aligned, LED light 198 will turn on indicating that the units are improperly aligned. In other words, the laser being emitted from unit 110 is not being properly received by unit 120. Once corrected, and the units are properly aligned, LED light 196 will turn on confirming proper alignment. It is also contemplated that the system create an auditory signal notifying the care giver that the units are properly or improperly aligned. For example, in the case that the unit is not properly aligned, a series of continuous auditory beeps will sound from speaker 118, letting the care giver know that the system is not ready. Once properly aligned the system may give a long beep to notify the care giver that the units are properly aligned. Furthermore, it is contemplated that the system be linked an electronic device, such as an ipad, iPhone, tablet, smart phone, smart watch, or the like, that includes a mobile device app that notifies the care giver that the system is properly or improperly aligned.

Although the units may be turned on and off via switch 116, for the sake of brevity, the remaining description provided herein below will be under the understanding that switch 116 is on the ON position. Continuing on FIGS. 6 and 8, once unit 110 and unit 120 have been properly coupled to an object 130, and are properly aligned confirmed by LED light 196 (i.e., the unit is ready to be used), the laser monitor system 100 is automatically activated. When initially activated, the system 100 is in a dormant state. In other words, all of the respective alignment, activation, and alarm lasers are properly being received by their respective alignment, activation, and alarm sensors. The system 100 will continue in a dormant state until a care giver turns the system off, or the lasers being emitted receive interference.

Figure 10:
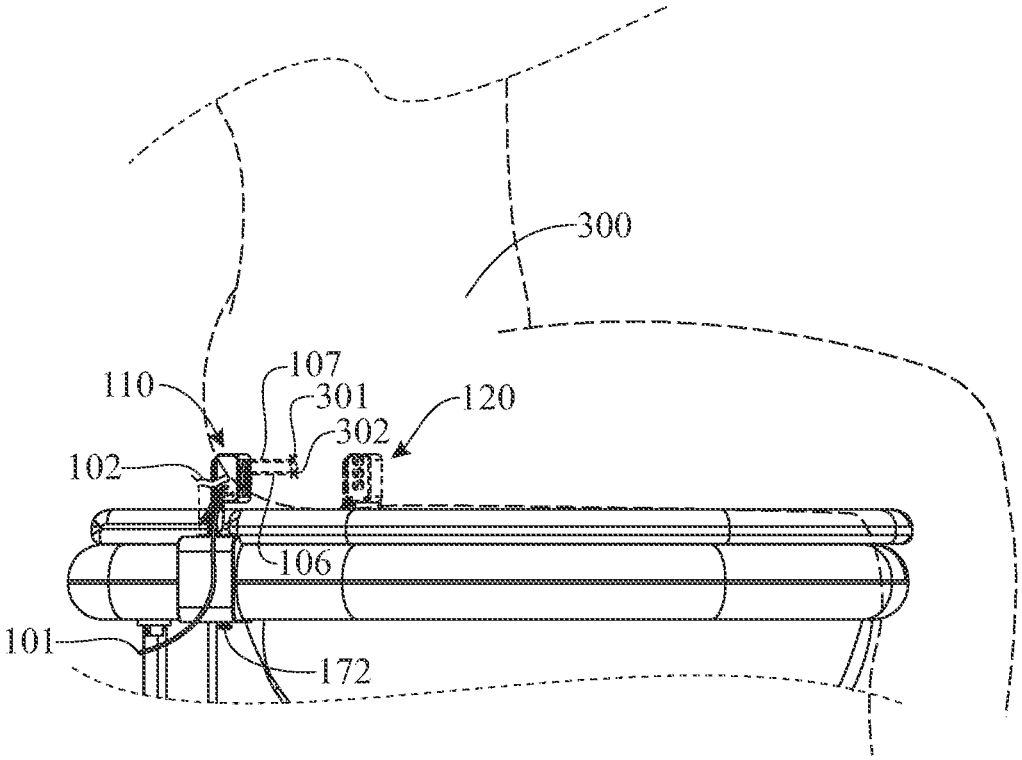
FIG. 10 presents a left side skewed view of the laser alert system mounted to the toilet in use.
Figure 11:
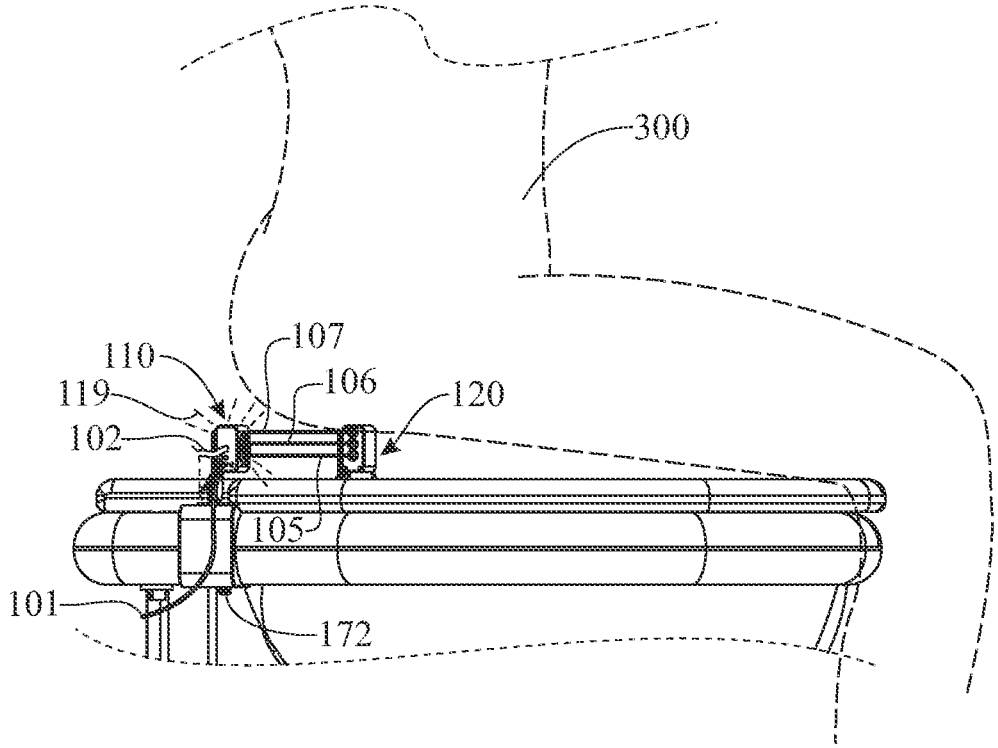
FIG. 11 presents a left side skewed view of the laser alert system mounted to the toilet in use.

For example, as illustrated in FIGS. 10 and 11, the system 100 remains dormant until a patient 300 interferes with the alarm laser 107 being emitted from unit 110. As soon as the laser 107 is broken for a pre-set amount of time clocked by a timer (i.e., there is a foreign object interfering the alarm laser from reaching the alarm sensor 124), the system immediately switches to a pre-alarm state. For example, the timer may be set for 2-5 seconds. Meaning, if the laser signal is interrupted for longer than the pre-set minimum, the system automatically changes from a dormant state to a pre-alarm state. After the system 100 has been properly armed and in a pre-alarm state, the system 100 is designed to activate as soon as the patient tries to get up and the alarm laser is once again received by its respective sensor. This triggers an audible alarm that may include a pre-recorded message by a loved one (or a generic recording) asking the patient to sit back down and wait for help. If the patient sits back down and, once again, interferences between the alarm laser 107 and the alarm sensor 124 occurs, the system deactivates and returns to a pre-alarm state. Conversely, if the patient tries to get up with the care giver at their side, the care giver pushes the reset button 117 on the unit 110 to turn off the alarm and put the system 100 back to a dormant state. This cycle continues when the patient sits back down on object 130. As an alternative example (not shown), the care giver is provided with a device that is attachable to their garment with said device being able to emit a signal that is detectable by units 110 and 120 when the device is in close proximity. For example, 1-4 feet away. Whenever a patient 300 tries to get up without assistance, the system 100 produces an audible alarm as described herein above. If the patient 300 has a care giver with them, however, the system detects the device worn by the caregiver and automatically resets. This approach omits the need for the caregiver to press the reset button when it is not necessary.

Figure 13:
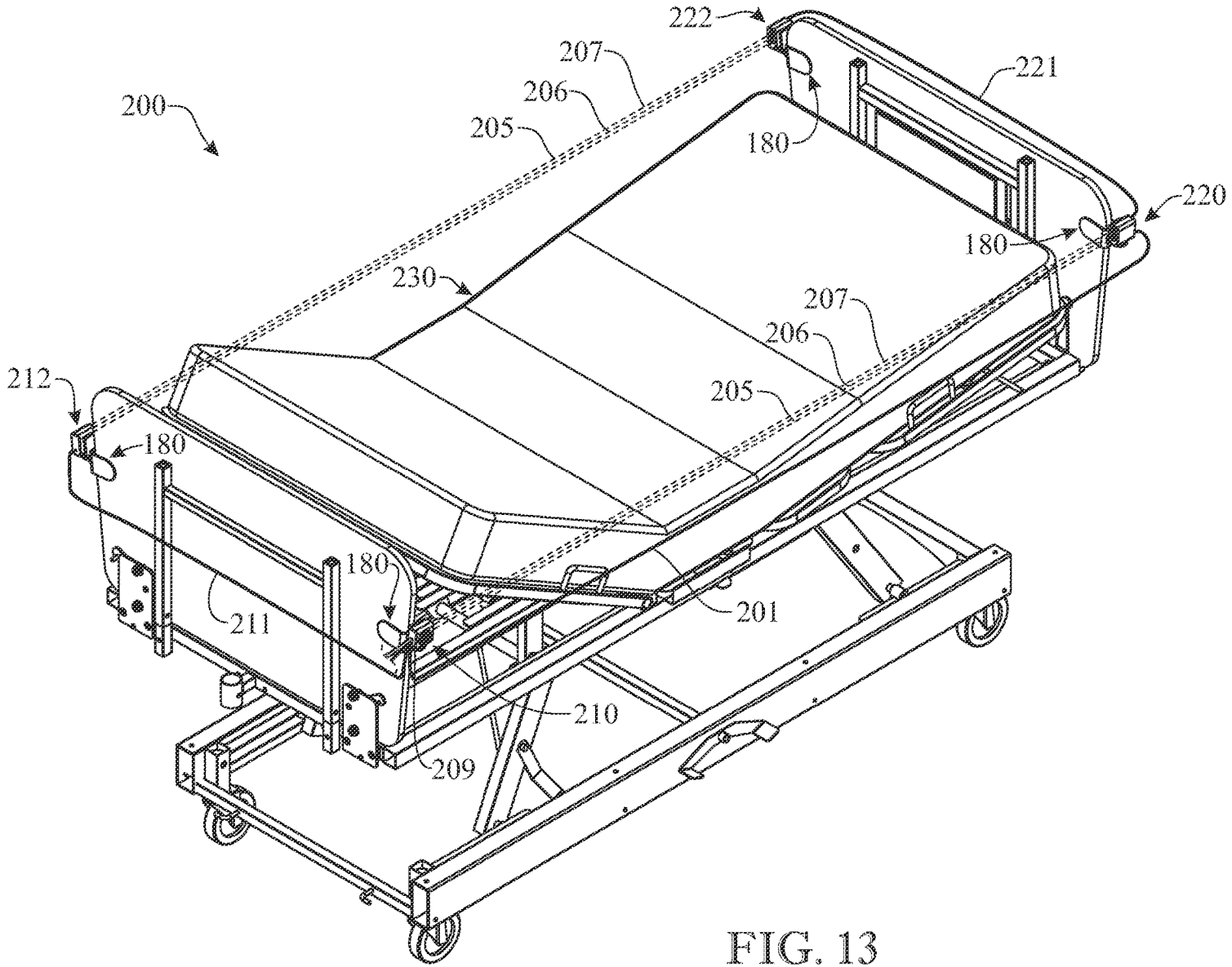
FIG. 13 presents a rear isometric view of the laser alert system originally shown in FIG. 1, being selectively mounted to a hospital bed at the foot and head of the bed.
Figure 14:
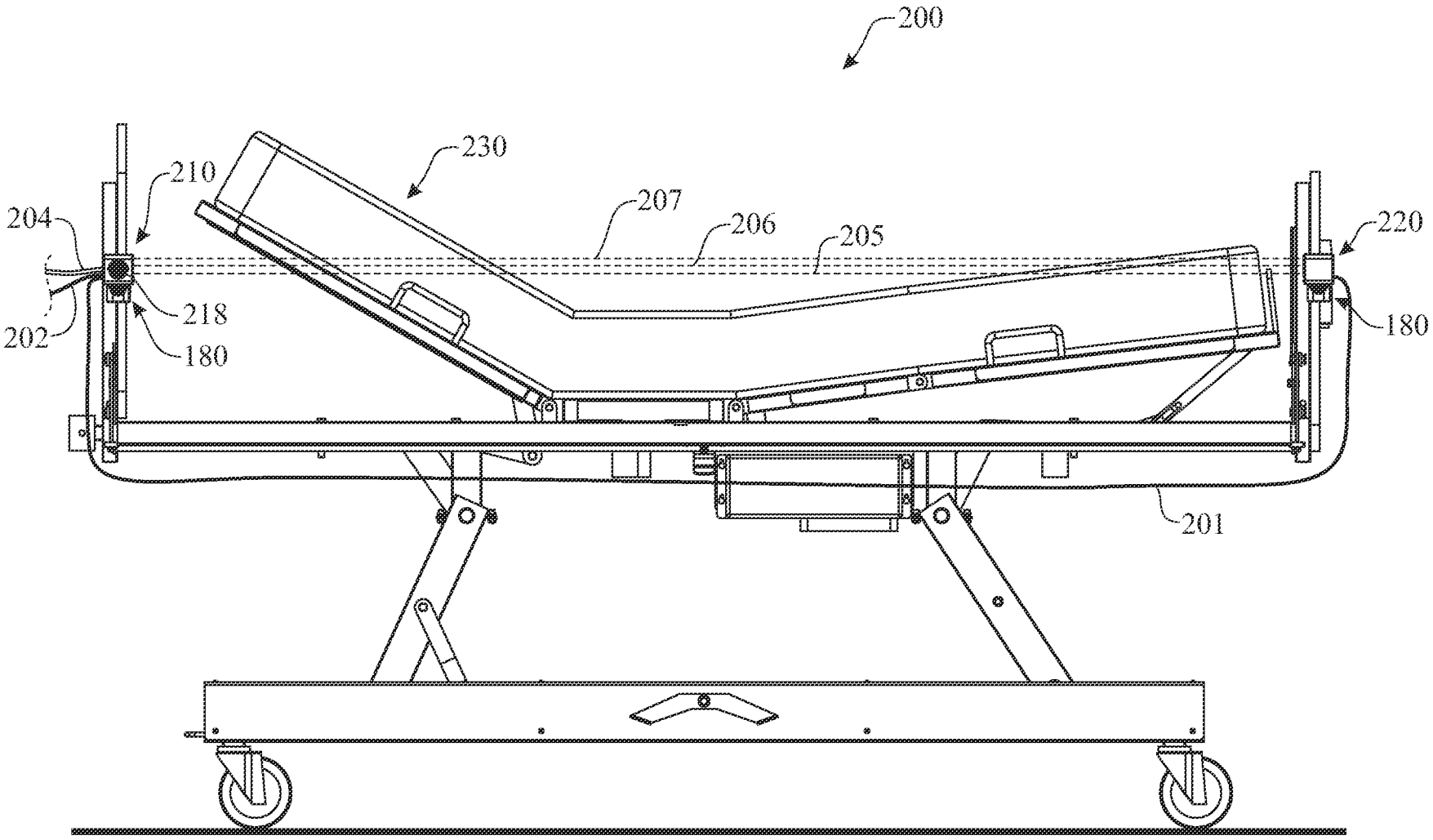
FIG. 14 presents a side view of the laser alert system selectively mounted to a hospital bed.

Turning now to FIGS. 12 and 13, in an alternative embodiment of the present invention, a system 200 is generally shown. It should be readily understood that system 100 and system 200 are fairly similar, and as such, like references are numbered the same with the prefix '2'. System 200 may generally include a first and second emitting units 210, 212, that are connected adjacent one another, and a first and second receiving units 220, 222 that are also connected adjacent one another. In this exemplary form of the present invention, the system 200 is meant to be attached to a movable object, such as, a bed having two sides. However, the system 200 (as well as system 100) may be selectively attached to other types of movable objects, such as wheel chairs or the like. As illustrated, unit 210 may include a power supply cord 204 that may be connected to a power supply, and include a communication cord 202 that is selectively attachable to an existing communication system (not shown). As stated above, emitting unit 210 may be connected to emitting unit 212, and receiving unit 220 may be connected to receiving unit 222. Each unit may be selective attached to the head and foot of a bed frame via mounting bracket, such as, the swivel U-mount 180 that was described herein above. For the sake of brevity, it should be readily understood that the principles of operation of system 200 are identical to the principles of operation of system 100 as was described heretofore. The only difference being that instead of one pair of units, two pairs of receiving and emitting units are utilized to monitor the patient from getting off the bed on either side. Giving the care giver confidence that they can step away from their patient and continue to provide care for others without having to worry about an accidental fall.

Figure 16:
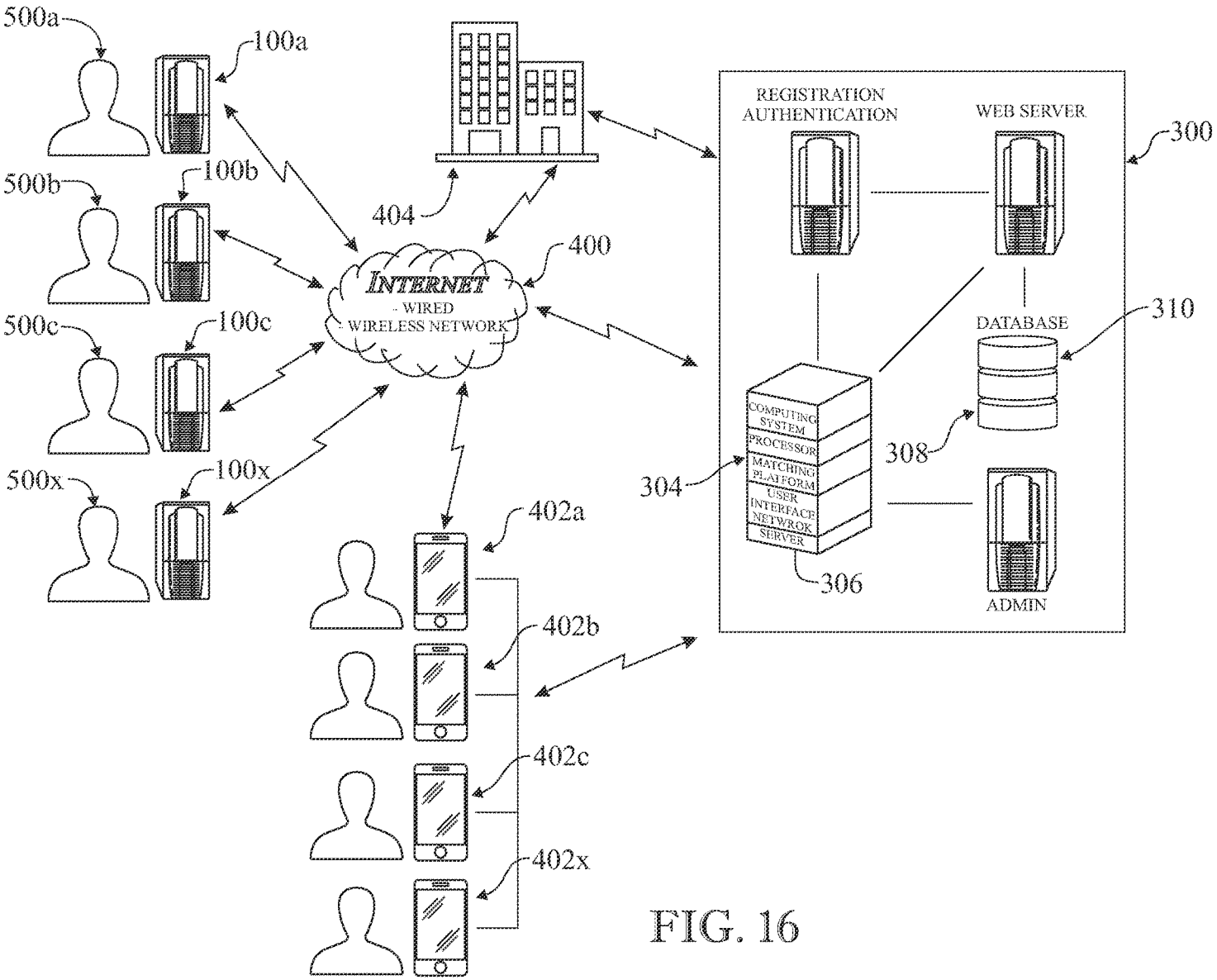
FIG. 16 presents a schematic view of a cloud-based system, illustrating how the care facility and the guardian of a patient or person are notified if the patient is getting up unattended.
Figure 17:
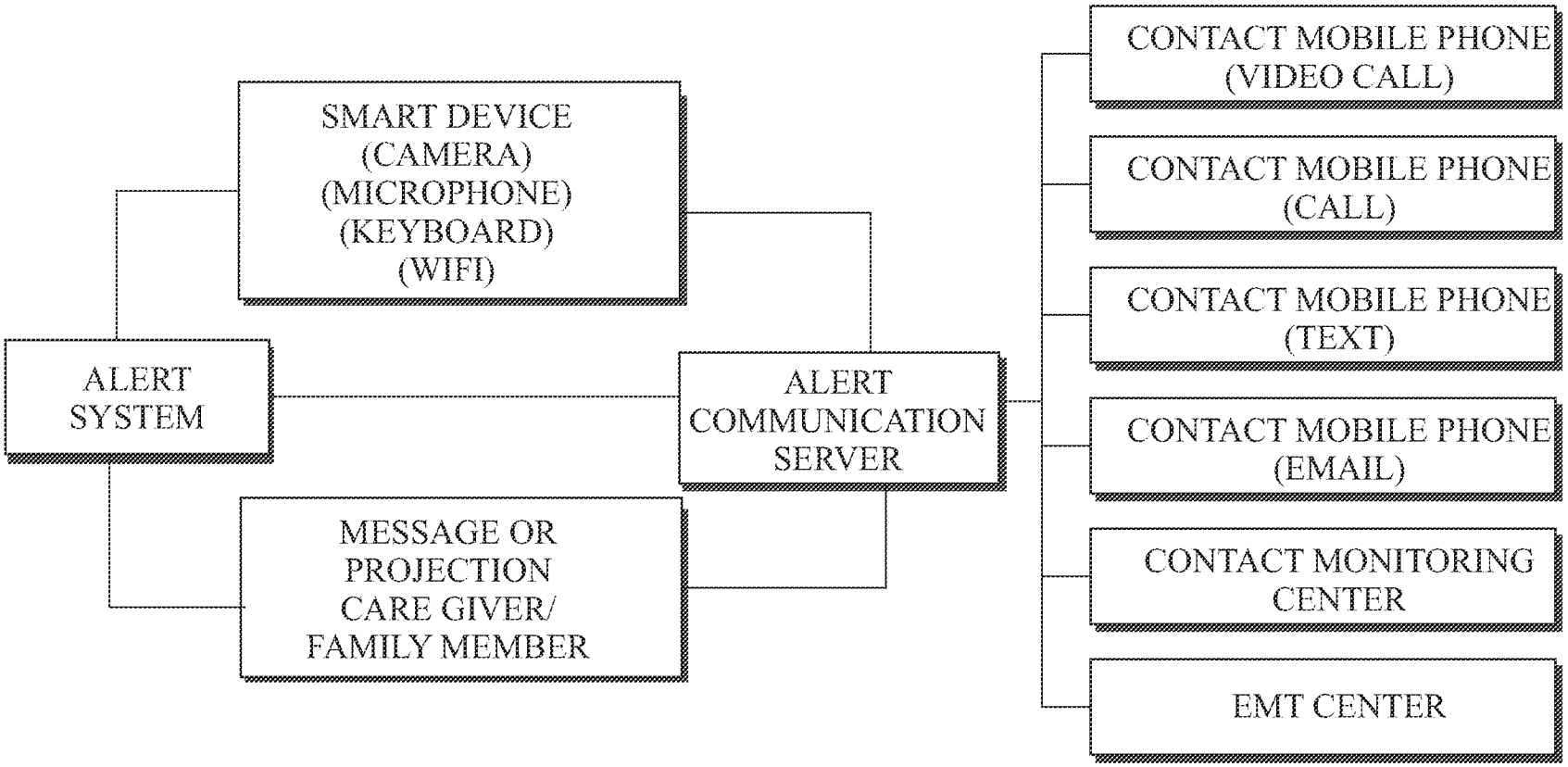
FIG. 17 presents a logic schematic of an updated version of the laser alert system originally shown in FIG. 1.

Referring now to FIGS. 1, 16, and 17, and in particular FIG. 16, a schematic view of a cloud-based system 300, showing a plurality of laser monitoring system units 100 in electrical communication with the cloud-based system 300 and a matching platform 304 hosted on the cloud service system 300 is shown. The cloud-based system 300 of the present invention provides a laser monitoring system application ("app") to be downloadable to an electronic device via a network 400. As described above, briefly, the laser monitoring system 100 generally comprises a first unit 110 and a second unit 120 that communicate with each other and have electronic communication capabilities. As seen in FIG. 16, each combined unit 100*a*, 100*b*, 100*c*, 100*x*, i.e., first unit and second unit, can electrically communicate through the network 400 with the cloud service system 300. A plurality of electronic devices 402*a*, 402*b*, 402*c*, and 402*x* are also shown to be communicable through the network 400 with the cloud service system 300 hosting the matching platform 302. In one exemplary embodiment, the cloud service system 300 may also communicate with at least one health care center 404 that is given access to the cloud-based system 300. One will appreciate that a healthcare center may include a hospital, a nursing center, an emergency center, an outpatient center, a home, and any other location where one may care for the sick, incapacitated, elderly, or the like.

With continued reference to FIG. 16, the one or more electronic devices 402*a-x* generally comprise a handheld, portable mobile or smart phone, tablet, lap top computer or work station and may include audio and video circuitry, a keyboard or touchpad, memory or access to memory, one or more processors, I/O network interface, application program interface, read/write memory (RAM), read-only memory (ROM), and a visual screen or display for downloading and navigating through the matchmaking app. Each device in the healthcare center may include audio and video circuitry, a keyboard or touchpad, memory or access to memory, one or more processors, I/O network interface, application program interface, read/write memory (RAM), read-only memory (ROM), and a visual screen or display for communicating with the cloud service system 300 hosting the platform 304.

Each electronic device, including the monitoring system 100, utilized to connect to the cloud services system 300, hosting the matching platform 304, electrically communicates via wired (land line), wireless, or internet network 400, including VIOP (voice over internet protocol) network. The communication network 106 may include wireless communication including but not limited to: WLAN (wireless local area network, Wi-Fi (IEEE 802.11), WPANS (wireless personal area networks, such as Bluetooth (IEEE 802.15), Infrared, ZigBee), WMAN (wireless metropolitan area network, such as WiMax (IEEE 802.16)), WWAN (wireless wide area networks, internet), and GAN (global area network), a mobile wireless communication system, such as 3G, 4G, or 5G, an internet-protocol based communication system. The communication network may also include a wired communication including but not limited to, fiber optic systems, a telephone network such as a PSTN (public standard telephone network). The communication network may further include a radio frequency network (RF), a cable network, a satellite network, and an internet or intranet network, where each network is adapted for transmitting, and receiving data, information, audio, video, texts, messages, emails, and files between electronic devices 104*a-x*, units 100*a-x*, and cloud services system 300. It will be noted that network, interface, communication and information exchange equipment, components or peripherals may be employed, including, but not limited to, use of base stations, servers, routers, switches, repeaters, towers, antennas, Ethernet hubs, wired or wireless data pathways, modems, virtual private networks (VPN), modems, proxy servers, application program interfaces (APIs), networking adapters, or gateways. Encryption protocols may also be employed to secure the transmitted information, data, or messages. For example, a few exemplary forms of encryption include IPsec, or secure sockets layer (SSL), and symmetric or asymmetric encryption.

The cloud service system 300 includes at least one cloud-based server 306 that may comprise one or more servers, computers, I/O and/or network interfaces, processors, memory, and necessary computer readable medium for storing, processing, operating, sharing, transferring, and receiving, data, files, videos, images, audio, and other information, and for performing computations, hosting web pages and/or applications, maintaining and communicating with databases, processing software application source cloud, and other operatives associated with software functionalities. In one exemplary embodiment, the one or more cloud-based servers 306 may include an application server, a web server, a computing server, a communications server, a database or file server, a mail server, a proxy server, or additional servers. The cloud-based server 306 can be managed, controlled and operated by a designated internet service provider, dedicated management, or third party. As such the server 306 may be managed by any of an application service provider (ASP) offering on-demand software or software as a service, a network service provider (NSP), an internet service provider (ISP), a managed service provider (MSP), or a telecommunication service provider (TSP) where providers can charge an ongoing subscription or fixed fee service to users. The server memory may comprise any suitable memory technology, such as static random access memory (SRAM), synchronous dynamic RAM (SDRAM), nonvolatile/flash-type memory, or any other type of memory. Machine-executable program instructions or computer application programs associated with the augmented reality software platform may be stored on one or more machine readable mediums, including but not limited to, optical disk, magnetic or optical card or tape, flash memory, CD/DVD-ROM, memory dongle, magnetic storage media such as a hard drive or any other external machine-readable medium coupled to server or server computer via, I/O interface. Computer-accessible medium may include any volatile or non-volatile media such as RAM (e.g. SDRAM, DDR SDRAM, RDRAM, SRAM, etc.), ROM, EEPROM, or EPROM.

One will appreciate that the cloud service system 300 may include a plurality of databases 308 for hosting, storing, sharing, and managing information, such as images, audio or video message content, and data associated with managing, transmitting, providing, playing, and otherwise delivering data to users. As is illustrated in FIG. 16, the plurality of databases 306 are in digital communication with the cloud services matching platform 304 and/or cloud-based server 306, and includes, or has accessible communication or storage capacity with, internal or external storage comprising of optical disks, CD-ROM, flash memory or USB storage devices, or other machine readable medium suitable for storing computer source code, file manifests, index manifest, instructions, data tables, look-up tables, files, data, information, or folders. It is appreciated that the cloud-based server 306 and databases 308 may be entirely included within, and made part of, the cloud-based system 300, or maintained at one or more separate physical or geographical locations from the cloud-based system 300.

The cloud system 300 includes a user management database 310 that indexes information belonging to or associated with each person. The user management database is in communication with the matching platform 304, the units, and the electronic devices paired with said units. The user management database may store any personal information that identifies a particular person. For instance, one will appreciate each unit 100*a-x* is assigned to a particular patient or person 500*a-x* that requires assistance. For example, person 500*a* is assigned to unit 100*a*, person 500*b* is assigned to unit 100*b*, and so on and so forth. Each unit is communicable via the network 400 to the cloud-based server 300 and/or the healthcare unit 404. In one example, the unit 100*a* is assigned an identification marker and stored in database 310, where the person's personal information is stored—for instance, the person's name, age, and sex. Personal information, such as voice recordings, images, or the like, are also saved within the database. The database 410 is in electronic communication with all of its cloud-based server components, including the matching platform 304 of the system. Each unit and the respective electronic device it pairs with have unidirectional and/or bidirectional communication capabilities.

With reference to FIGS. 12, 16, and 17, in one exemplary mode of practice, a pair of units 210, 212 are connected to a bed 230 where a person will typically lay or sit, such as a bed or chair. The units 210, 212 may be electronically connected via network 400 to the healthcare center 404 switchboard that monitors patients. In another example, the units 210, 212, which on FIG. 16 are referenced as reference numbers 100*a-x*, communicate with the cloud-based server 300. The cloud-based server 300, particularly the matching platform 304, parses through each unit and pairs each unit

100*a-x* with an electronic device 402*a-x* belonging to the persons' choosing. The person with the electronic device 402*a-x*, in some examples, can be the person's family member, guardian, legal representative, or family friend. For example, unit 100*a* of person 500*a* is paired with electronic device 402*a* belonging to a member known to person 500*a*. In one exemplary embodiment, the pairing between one electronic device and a paired unit may occur through the use of the downloadable application provided by the cloud-based system that allows user to use the electronic device to scan a code, such as a QRC code, or enter a reference number provided on the paired device, to pair the electronic device with the paired device. The pairing of the unit and electronic device is recognizable within the cloud-based system. The same pairing occurrence may occur for all of the remaining units, as shown in FIG. 16. Put differently, each particular device 100*a-x* is connected or in sync with a particular electronic device 402*a-x* that directly puts a patient or person 500*a-x* in direct communication with a chosen member operating any one of the particular electronic devices of 402*a-x*.

With reference now to FIGS. 16 and 17, in the event a person laying on a bed or sitting in a chair decides to get up unassisted, triggering the alarm system of the unit 100*a-x*, a signal is sent through the network 400 to the cloud-based system 300, where the matching platform 304, using the database 310, identifies the electronic device paired with the unit and sends an electronic communication signal message. As shown in FIG. 17, the electronic communication signal message may be in the form of a phone call, video call, text message, SMS message, email, push notification, or any other valid and existing type of electronic message to the electronic device paired to that particular unit. For example, the person paired with the unit's electronic device may receive, in one exemplary embodiment, a message that their loved one is trying to get up unassisted from their bed in the form of an SMS that states, "Brian is getting up." In turn, because the unit and the electronic device paired have directional communication capabilities, the person with the use of the electronic device can elect to speak to the person through the unit's speakers and ask that the person remain seated or on the bed. Alternatively, the unit may activate a pre-recorded message asking the person to remain where they are and wait for assistance, as described in detail hereinabove. How a message is playable on each unit has been described above in greater detail, and thus it is not repeated hereinbelow. Simultaneously, or alternatively to the alarm message, the healthcare center, e.g., EMT center or contacting center, can receive an electronic notification that the person is trying to get up unassisted. The staff personnel monitoring those internal systems can then act per their training and protocols.

Each unit of the invention may include at least two modes in addition to what has already been described hereinabove as default settings. A first mode provides the ability for each unit to be programmed to operate under a bed mode. While in bed mode, the unit emits a constant laser beam alarm that breaks when penetrated by a person. The interruption of the laser beam triggers the alarm, as is well described hereinabove. A second mode includes chair mode having a soft trigger alarm. The soft trigger alarm may include an audible alarm, or in some examples where the unit provides a visual display, include a video message, warning the patient to remain seated until they receive assistance. The video or audio message can be pre-recorded from a loved one, such as a family member or any one known to the patient. Suppose the patient persists in moving from the chair. In that case, while in chari mode, the alarm system contacts the healthcare staff and/or sends a message to the electronic device paired with the unit with an alert that the patient is trying to get up unassisted.

Although not presently shown, some units may include screens or monitors that allow for the person trying to get up to view and hear a loved one asking them to remain seated. In summary, the present invention is designed to prevent avoidable accidents within healthcare centers and homes across the country, leading to more severe medical issues.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A cloud-based laser monitoring system communicable with a laser monitoring system designed to prevent accidental falls, comprising:

a cloud-based system connectable to a network including a digital platform stored on one or more computer readable storage media executed by one or more processors on a cloud-based service in electrical communication with a user management database, allowing the cloud-based system to:

receive a user's request to access the digital platform through an electronic device, receive the user's request to upload digital media content to the digital platform to be stored in the user management database, and allow the digital media content to be retrievable and electronically transmittable to a laser monitoring paired device when an alarm is activated, and send a notification to the electronic device notifying the user that the alarm of the laser monitoring paired device activated; and a first monitoring unit and a second monitoring unit;

wherein the first monitoring unit and the second monitoring unit are selectively linked to one another to form the laser monitoring paired device that provides a penetrable laser net alarm that when penetrated activates the alarm, and wherein the laser monitoring paired device electrically communicates with the cloud-based system over the network to allow for the digital platform to electronically communicate with the laser monitoring paired device.

2. The cloud-based laser monitoring system of claim 1, wherein the first monitoring unit comprises, a circuit board;

a laser emitting device;

at least one alignment indicator;

an alarm speaker;

a wireless communication emitting device, the wireless communication device signaling the second monitoring unit to connect to the first monitoring unit;

a networking communication device communicable with the network;

a power supply energizing the first monitoring unit; and an electrical housing, the electrical housing having an internal space for retaining the circuit board, the laser emitting device, the alignment indicator, the wireless communication device, the power supply, and the alarm speaker.

3. The cloud-based laser monitoring system of claim 2, wherein the second monitoring unit comprises, a circuit board;

a laser receiving device;

at least one alignment indicator;

a power supply energizing the second monitoring unit;

a networking communication device communicable with the network;

a wireless communication receiving device, the wireless communication receiving device configured to receive signals from the first monitoring unit to pair the first monitoring unit with the second monitoring unit; and an electrical housing, the electrical housing having an internal space for retaining the circuit board, the laser receiving device, the alignment indicator, the power supply, the networking communication device, and the wireless communication receiving device.

4. The cloud-based laser monitoring system of claim 1, the laser monitoring unit includes at least two programmable modes that include a bed mode and a chair mode.

5. The cloud-based laser monitoring system of claim 4, wherein bed mode includes the laser monitoring paired device emitting a laser beam alarm that when penetrated triggers the alarm.

6. The cloud-based laser monitoring system of claim 4, wherein chair mode includes the laser monitoring paired device emitting a laser beam alarm that when penetrated triggers a soft alarm.

7. The cloud-based laser monitoring system of claim 6, wherein the soft alarm comprises an audio message or a video message playable on at least one speaker of the laser monitoring paired device.

8. The cloud-based laser monitoring system of claim 1, wherein the digital media content stored in the user management database comprises any one of an audio message and video message.

9. The cloud-based laser monitoring system of claim 1, wherein the notification sent to the electronic device of the user comprises anyone of a phone call, a video call, a text message, an iMessage, a SMS message, an email, or push notification message.

10. The cloud-based laser monitoring system of claim 1, wherein the alarm includes an audible alarm playable through at least one speaker of the laser monitoring paired device.

11. The cloud-based laser monitoring system of claim 1, wherein directional communication is establishable between the electronic device and the laser monitoring paired device through the digital platform.

12. The cloud-based laser monitoring system of claim 11, wherein the user can use the electronic device to speak and be heard through at least one speaker on the laser monitoring pair device.

13. A cloud-based laser monitoring system communicable with a laser monitoring system designed to prevent accidental falls, comprising:

a cloud-based system connectable to a network including a digital platform stored on one or more computer readable storage media executed by one or more processors on a cloud-based service in electrical communication with a user management database, allowing the cloud-based system to:

receive a user's request to download and access the digital platform in the form of a downloadable application operable on an electronic device, receive the user's request to upload digital media content to the digital platform to be stored in the user management database, link the electronic device to a paired laser monitoring device;

allow the digital media content to be retrievable and transmittable to the paired laser monitoring device when an alarm is activated; and send a notification to the electronic device notifying the user that the alarm of the laser monitoring paired device activated;

a first monitoring unit and a second monitoring unit; and a universal mount affixed to the first monitoring unit and the second monitoring unit, the universal mount attachable to a mountable surface;

wherein the first monitoring unit and the second monitoring unit are selectively linked to one another to form the laser monitoring paired device that provides a penetrable laser net alarm that when penetrated activates the alarm, and wherein the laser monitoring paired device electrically communicates with the cloud-based system over the network to allow for the digital platform to electronically communicate with the laser monitoring paired device.

14. The cloud-based laser monitoring system of claim 13, wherein the universal mount is mountable to any one of a chair, commode, or bed.

15. The cloud-based laser monitoring system of claim 13, wherein the alarm includes an audible alarm playable through at least one speaker of the laser monitoring paired device.

16. The cloud-based laser monitoring system of claim 13, wherein the notification sent to the electronic device of the user comprises anyone of a phone call, a video call, a text message, an iMessage, a SMS message, an email, or push notification message.

17. A cloud-based laser monitoring system communicable with a plurality of laser monitoring systems designed to prevent accidental falls, comprising:

a cloud-based system connectable to a network including a digital platform stored on one or more computer readable storage media executed by one or more processors on a cloud-based service in electrical communication with a user management database, allowing the cloud-based system to:

receive a plurality request from a plurality of users to download and access the digital platform in the form of a downloadable application operable on an electronic device, receive distinct requests by each user to upload digital media content to the digital platform to be stored in the user management database, index and assign the uploaded digital media to each respective one user stored in the user management database, link each individual electronic device operating the digital platform to a respective paired laser monitoring device;

allow the digital media content associated with that respective user to be retrievable and transmittable to the paired laser monitoring device when an alarm is activated; and send a notification to the electronic device of that respective user notifying the user that the alarm of the laser monitoring paired device activated;

a first monitoring unit and a second monitoring unit; and a universal mount affixed to the first monitoring unit and the second monitoring unit, the universal mount attachable to a mountable surface;

wherein the first monitoring unit and the second monitoring unit are selectively linked to one another to form the laser monitoring paired device that provides a penetrable laser net alarm that when penetrated activates the alarm, and wherein the laser monitoring paired device electrically communicates with the cloud-based system over the network to allow for the digital platform to electronically communicate with the laser monitoring paired device.

18. The cloud-based laser monitoring system of claim 17, wherein the digital media content stored in the user management database comprises any one of an audio message and video message.

19. The cloud-based laser monitoring system of claim 17, wherein the notification sent to the electronic device of the user comprises anyone of a phone call, a video call, a text message, an iMessage, a SMS message, an email, or push notification message.

20. The cloud-based laser monitoring system of claim 17, wherein directional communication is establishable between each electronic device and each respective laser monitoring paired device through the digital platform, such that the user can speak through the electronic device and be heard through at least one speaker on the laser monitoring paired device.

* * * * *